US011512578B2

(12) United States Patent
Moore et al.

(10) Patent No.: US 11,512,578 B2
(45) Date of Patent: Nov. 29, 2022

(54) DOWNHOLE ACTIVE TORQUE CONTROL METHOD

(71) Applicant: WWT NORTH AMERICA HOLDINGS, INC., Houston, TX (US)

(72) Inventors: Norman Bruce Moore, Aliso Viejo, CA (US); Rudolph Ernst Krueger, V, Anaheim, CA (US); Philip Wayne Mock, Costa Mesa, CA (US); Rudolph Ernst Krueger, IV, Cypress, TX (US)

(73) Assignee: WWT North America Holdings, Inc., Houston, TX (US)

( * ) Notice: Subject to any disclaimer, the term of this patent is extended or adjusted under 35 U.S.C. 154(b) by 63 days.

(21) Appl. No.: 17/124,271

(22) Filed: Dec. 16, 2020

(65) Prior Publication Data

US 2021/0198997 A1 Jul. 1, 2021

Related U.S. Application Data

(60) Provisional application No. 62/955,256, filed on Dec. 30, 2019.

(51) Int. Cl.

| | |
|---|---|
| ***E21B 44/04*** | (2006.01) |
| ***E21B 47/12*** | (2012.01) |
| ***E21B 47/06*** | (2012.01) |

(52) U.S. Cl.

CPC ..... *E21B 44/04* (2013.01); *E21B 47/06* (2013.01); *E21B 47/12* (2013.01)

(58) Field of Classification Search

CPC ..... E21B 44/005; E21B 44/04; E21B 47/06; E21B 47/12

See application file for complete search history.

(56) References Cited

U.S. PATENT DOCUMENTS

2008/0156486 A1* 7/2008 Ciglenec ..... E21B 49/10 700/282
2013/0245950 A1* 9/2013 Jain ..... E21B 10/00 702/9

(Continued)

OTHER PUBLICATIONS

International Search Report and Written Opinion issued in corresponding International Application No. PCT/US2020/066696, dated Mar. 8, 2021, 17 pages.

*Primary Examiner* — Caroline N Butcher
(74) *Attorney, Agent, or Firm* — Lewis Roca Rothgerber Christie LLP

(57) ABSTRACT

A method and system of adjusting near-bit weight on a drill bit in a drill string having a bottom hole assembly located at an end of a drill pipe, an anti-stall device near the bottom hole assembly, surface sensing and control equipment and a downhole-to-surface communication system, the anti-stall device measuring downhole performance criteria and evaluation of the measured downhole performance criteria, comprising the steps of measuring at least one downhole performance criteria by the anti-stall device; evaluating the measured downhole performance criteria in substantially real time by the anti-stall device; adjusting weight on the drill bit by the anti-stall device based on the evaluation by the anti-stall device; and communicating the adjustment to weight on the drill bit to the surface sensing and control equipment by the downhole-to-surface communication system for further adjustment of weight on the drill bit.

15 Claims, 4 Drawing Sheets

(56) References Cited

U.S. PATENT DOCUMENTS

| | | | | |
|---|---|---|---|---|
| 2016/0076354 | A1* | 3/2016 | Lai | E21B 44/00 702/9 |
| 2016/0090832 | A1* | 3/2016 | Mock | E21B 44/04 175/27 |
| 2017/0183940 | A1* | 6/2017 | Bailey | E21B 41/0092 |
| 2019/0187012 | A1 | 6/2019 | Wu et al. | |

* cited by examiner

DOWNHOLE ACTIVE TORQUE CONTROL METHOD

CROSS-REFERENCE TO RELATED APPLICATION(S)

This application claims priority to and the benefit of U.S. Provisional Application No. 62/955,256, filed Dec. 30, 2019, the contents of which are incorporated herein by reference.

BACKGROUND OF THE INVENTION

Improving drilling efficiency has become paramount to the exploration and exploitation of unconventional oil production in the US and other regions. These efforts at cost reduction have resulted in dramatic drilling time and drilling cost reduction. For example, in 2015, drilling a horizontal well in the Bakken play in North Dakota that was 10,000 feet vertical depth and 5,000 feet horizontal length required about 10 weeks; in late 2018 the same well in the same region required 8 days of drilling, i.e. an 86% reduction in drilling time and associated cost.

The majority of the several thousand wells drilled each year are drilled with a conventional bottom hole assembly (BHA), which consists of a drill bit, a measurement-while-drilling (MWD) equipment, a bent-sub downhole (positive displacement) motor and sometimes other instrumentation such as logging-while-drilling (LWD) equipment.

When drilling with a conventional BHA, drilling the horizontal sections consists of drilling by "rotating" and "sliding". "Rotating" drilling is rotating the entire drill string to drill ahead; "sliding" is not rotating the drilling string, but rather pumping drilling fluid to a downhole motor that rotates the drill bit to drill ahead. Slide drilling is used to make changes in the drilling direction. Typically, "rotating" drilling is 2-4 times faster than slide drilling.

Problems occur in drilling efficiency and the rate-of-penetration (ROP) as the horizontal section gets longer, especially when slide drilling and at the transition points between "rotating" and "slide" drilling. Various drilling difficulties arise including stick-slip (erratic torque oscillations), whirl (erratic lateral drill string oscillations), bit-bounce (vertical oscillations of the drill string/bit), chaotic drilling (rapid changes from lateral to torsional vibrations), downhole motor stalls and bit damage. In addition, during drilling of sliding sections loss of steering tool face orientation because of torque variations forces slower drilling and reduced efficiency. These problems result in lower ROP and greater costs.

When drilling and stick-slip is encountered, the remedy is to reduce the weight-on-bit (WOB) as quickly as possible. When whirl is encountered, the remedy is to increase the WOB and increase the drill string rpm as quickly as possible. When chaotic drilling occurs, the solution is to reduce WOB as quickly as possible. This typically requires intervention by the driller typically with an AutoDriller system.

Another significant influence on drilling costs is the slide drilling process. The historical process is a directional driller (DD) or more recently rig programmable logic controller (PLC) with software which computes the required slide length and steering direction, then performs the slide, and attempts to control the drilling performance.

The slide drilling process consists of two activities, off-bottom and on-bottom. Off-bottom activities consists of the subtasks of inputting reactive torque prior to tagging bottom and then detecting on-bottom torque in a timely manner; these pre-slide activities have wide variability in times from 8-25 minutes, depending upon the difficulty with starting the bit with its associated torque. The on-bottom activities focus on precise slide execution, that is, control of the toolface (sensing the orientation of the drilling assembly). Precise slide drilling is the consistent alignment in the desired direction; hence, the controlling concern for drilling efficiency is control of the toolface, not necessarily control by the AutoDriller.

Existing surface control equipment attempt to address these changes via monitoring of various surface equipment such as the top drive, the Auto-Driller, and the mud pumps. For example, surface instruments and software in the Auto-driller can detect changes in differential pressure of the drill string and respond by increasing or decreasing the slack-off weight, and after frictional losses by the drill string, change the weight on bit. For example, an alternative solution to reducing stick slip is to reduce the drill string rotational speed; this can be done manually or with sensors automatically altering the drill string rotational speed at the surface.

Again, the surface equipment's response is hampered by the response time to the drill bit. The slow response again results in lower ROP, especially when downhole events such as passing through hard formations or drilling from rotating to sliding or at greater horizontal lengths. The response to the bit is also limited by various non-uniform friction losses of the drill string to the casing along the well bore.

Another important aspect of controlling the drilling efficiency ROP is providing the appropriate response to various drilling dysfunctions such as stick-slip, whirl and bit bounce. Each drilling disfunction results in slower ROP and greater drilling costs.

A small percentage of more difficult or extremely long horizontal wells use rotary steerable (RS) tools. Because the RS is making constant corrections in the drilling path, slide drilling is not necessary. Further, the response time to the surface for downhole problems becomes a limiting factor for improving drilling efficiency. The use of RS results in significantly higher costs, and therefore is infrequently used. Most often, RS is used in wells with highly variable formations or very long (10,000 ft or greater) horizontal wells or in offshore wells. RS communicate to the surface with mud pulse telemetry.

U.S. Pat. No. 7,854,275 describes an Anti-Stall Tool for oil well drilling that controls reciprocation of the drill bit by a controller that alters the WOB depending upon the downhole pressure or torque. This device includes hydraulic valves adapted to control piston force. The system has three modes—forward movement of piston, backward motion of the piston, and locked position (no movement). This system senses pressure from the downhole motor and then hydraulically responds depending upon the pressure. Further, one embodiment comprises a spring-operated Anti-Stall Tool. This embodiment is effectively a closed loop between the downhole motor and the Anti-Stall Tool; the tool does not include provisions of communication to surface operations regarding downhole performance of the assembly. Therefore, the location of the Anti-Stall tool in close proximity of the bit with its own command and control system is inherently faster than any existing communication system that responds with surface equipment changes alone.

U.S. Pat. No. 8,833,487 describes a command and control sub for receiving input from the WOB and torque and other parameters to respond in real time thereby affecting the ROP and drilling efficiency as determined by mechanical specific energy (MSE). This sub may contain multiple sensors include vibration sensors, a WOB sensor, torque transducers, rotational speed and ROP sensors. These are combined through the command control sub to direct the ant-stall tool to move forward, backward, or stay in place thereby changing the downhole WOB, and hence torque.

U.S. Pat. Nos. 8,439,129 and 8,146,680 describe an anti-stall tool that controls reciprocation of the drill bit by a controller that alters WOB depending upon measured downhole pressure or torque. The controller receives preset high and low working pressure limits for the downhole motor and increases or decreases the WOB within limits thereby preventing downhole motor stalling.

U.S. Pat. No. 8,833,487 describes a downhole drilling assembly with WOB and torque sensors, RPM and ROP sensors, vibration sensors, and a command and control means to increase or decrease the WOB response to any of these parameters separately or to a programmed metric including Mechanical Specific Energy. Included within the described sub is the ability to provide feedback to the surface via the drill string including information via mud pulse telemetry. Hence, in this embodiment there exists an internal feedback control within the tool and another feedback to the surface via mud pulse.

There are several different types of communication systems from downhole to surface. The most common method is with mud pulse telemetry, electromagnetic-based systems, wired pipe and wireless communication.

Existing downhole equipment such as MWD uses mud pulse telemetry and is capable of communicating limited amounts of information to surface equipment and data acquisition; but is not capable of changing downhole WOB or torque. The detection and response to an increase in differential pressure or other drilling parameter as signaled by the MWD can take minutes, which is far too slow to prevent motor or bit damage before the surface equipment responds. It is known in the industry that whirl can damage a poly-crystalline diamond drill bit in less than 30 seconds. Further, significant loss in ROP occurs during these transition times. It is noted that mud pulse telemetry has a relative slow data transmission rate, for example 2-10 bits per second; the result is slow and provides inadequate information to the surface equipment for downhole control purposes. Most importantly, existing mud pulse communications systems can measure the bottom hole WOB, torque, or other parameters but any adjustments must be performed by surface controls such the top drive, Auto-Driller, and mud pumps. Again, all control loops involving mud pulse telemetry can deliver information, although slowly, but cannot directly apply WOB or control torque at the drill bit. The term "real-time monitoring" is applicable in a very limited context.

For example, U.S. Pat. No. 10,215,010 configures a controller at the surface to collect downhole information, determine a natural frequency of the drill string in lateral motion, determine correlative relationships, model a forward whirl region, generate a control algorithm, determine a top drive supervisor set point and provide operational control signals. Hence controls are at the surface and communication is via mud pulse telemetry to the surface. The communication to the surface via mud pulse telemetry may take 3-8 seconds from a tool to the surface equipment, then the equipment reacts which can require 3-10 seconds, and then not all the appropriate change in weight on bit occurs requiring additional adjustments as inappropriate WOB was delivered.

An alternative to using mud pulse telemetry for communication from the bottom hole assembly to the surface drilling control equipment is the use of "wired drill pipe". Wired pipe has an electrical line within it that conveys information from downhole sensors to a surface data acquisition system. Wired pipe, made by Novatek, can transmit data at 1 million bits per second. However, again, only information is delivered and returned to the downhole equipment; there is no capability to control WOB or torque. At present there are only a few "wired" pipe strings in the world; these are known to be very expensive to rent and are used primarily for drilling research projects. Like mud pulse telemetry systems, use of wired pipe allows information to be sent to surface equipment to control weight on bit; there is no existing system to alter WOB or torque near the drill bit.

For example, U.S. Pat. No. 10,273,752 discloses an automated drilling system that has a drilling control and information system comprised of a rig site network, a drilling equipment controller, a drilling parameter sensor, a downhole sensor, communicatively coupled to the rig site network that consists of a drilling parameter sensor in communication (via wired drill pipe) with a sensor application that generates processed data from raw data that is received from the drilling parameter sensors. A priority controller in communication with the process application evaluate the instruction for release to an equipment controller (at the surface) that then issues the instruction to one or more drilling components (at the surface). Communication is very fast (within 1 second) with the wired pipe, but the adjustments that are made at the surface still require 3-5 seconds to respond, and again, may well require additional repeated adjustment. This all comes at the high rental price of wired pipe. Finally, again all changes in WOB are from the surface, not at the drill bit.

Wireless communication downhole utilizes microprocessor-controlled frequency synthesis for two-way communication in the range of 100 Hz to 100 KHz. A non-magnetic downhole communication module has sensors or is connected to sensors. The drill pipe acts as an electrical lossy, single conductor with earth forming the electrical return path. Sensory data is encoded in digital format and impressed upon the drill string using frequency shift keying of the electromagnetic energy waves and is picked up at the surface by a signal receiver demodulator and message processor unit. The received signal is filtered, demodulated, processed and displayed at the surface. This method of communication is relatively fast to the surface but is slow in returning information to the downhole sensor. It sees use in applications with high well temperature or when lost circulation material (LCM) is used to control well fluid losses. This communication system has no means of adjusting WOB at or near the drill bit; rather it delivers information to the surface equipment for drilling control.

MWD tools determine the location of the tool in 3-dimensional space, communicates this information in pulsing pressures in the drilling fluid (either inside the drill pipe or in the annulus), the information is processed on the surface, and mud pulses send commands to the tool that change direction. There are many commercial suppliers of this type of equipment, numerous patents describe variations in control and communication.

Modern drilling rigs have control systems that attempt to control drilling from surface equipment and instrumentation. The systems typically include Autodriller which actuates the drilling rig's draw works brake handle using continuous feedback from hook load, drilling fluid pressure, draw works drum rotation and target rig depth sensor, and hence affects control of WOB with less frictional losses in the system. Typically, a driller can intervene with adjustments or control changes because of surface measurements. Weight is added to the bit until the drilling fluid pressure, ROP, or WOB is attained. It is standard practice that all information is recorded and typically presented on continuous electronic charts. Suppliers, such as Pason, National Oil Well Varco, Nabors, Schlumberger, Halliburton, Baker-GE and several others, provide entire systems.

Modern rigs have a top drive that provides clockwise torque to the drill string to drill the borehole. The top drive is comprised of one or more electric or hydraulic motors, which are connected to the drill string via a short section of pipe known as a quill. The top drive is suspended from a hook below the traveling block. The top drive effectively provides the rotation to the drill string. Modern top drives may or may not be completely automated, offering rotational control and torque. The sensors to control the torque are located on the surface, along with a communication infrastructure. Commercial suppliers include Schlumberger, Tesco, Canrig Drilling, Cameron, National Oil Well Varco.

In addition, many rigs have a "rocking" system to help deliver WOB. This system controls the top drive to rotate a specified number of turns to the right and then specified number of turns to the left thereby reducing hole friction, which allows more efficient transfer of weight from the surface to the drill bit.

In addition, drilling long horizontal wells use one or more "agitators" that induce vibration in the drill string, thereby reducing friction along a portion of the drill string, which helps deliver weight to the drill bit. The agitators are activated by pumping fluid down the drill string; the driller has no control over activation of the tool.

Most recently efforts for fully automated rigs have overlaid an artificial intelligence (AI) program that monitors rig sensors and determines appropriate responses to drilling conditions. Several companies including Baker-GE and Schlumberger are or have developed AI systems for controlling drilling process.

The existing systems either rely on surface measurements or use downhole measurements and alter drilling parameters at the surface by altering WOB, RPM, or differential pressure or other parameters via Autodriller, the top drive, or mud pumps. No system currently measures downhole drilling conditions and then actively (in real time) changes the WOB at the drill bit and simultaneously changes torque in the drill string that can be sensed both downhole and at the surface.

SUMMARY OF THE INVENTION

The present invention is a drilling system and method that enables drilling efficiency improvement by command and control coordination of an anti-stall device's ability to quickly measure torque, apply criteria to measured torque, adjust WOB downhole, and using drill string torque to communicate changes to the surface. This invention can be used in conjunction with existing rig drilling control systems. The invention disclosed herein interfaces to commercial equipment and suppliers of a communication system for the system.

DETAILED DESCRIPTION

Figure 1:
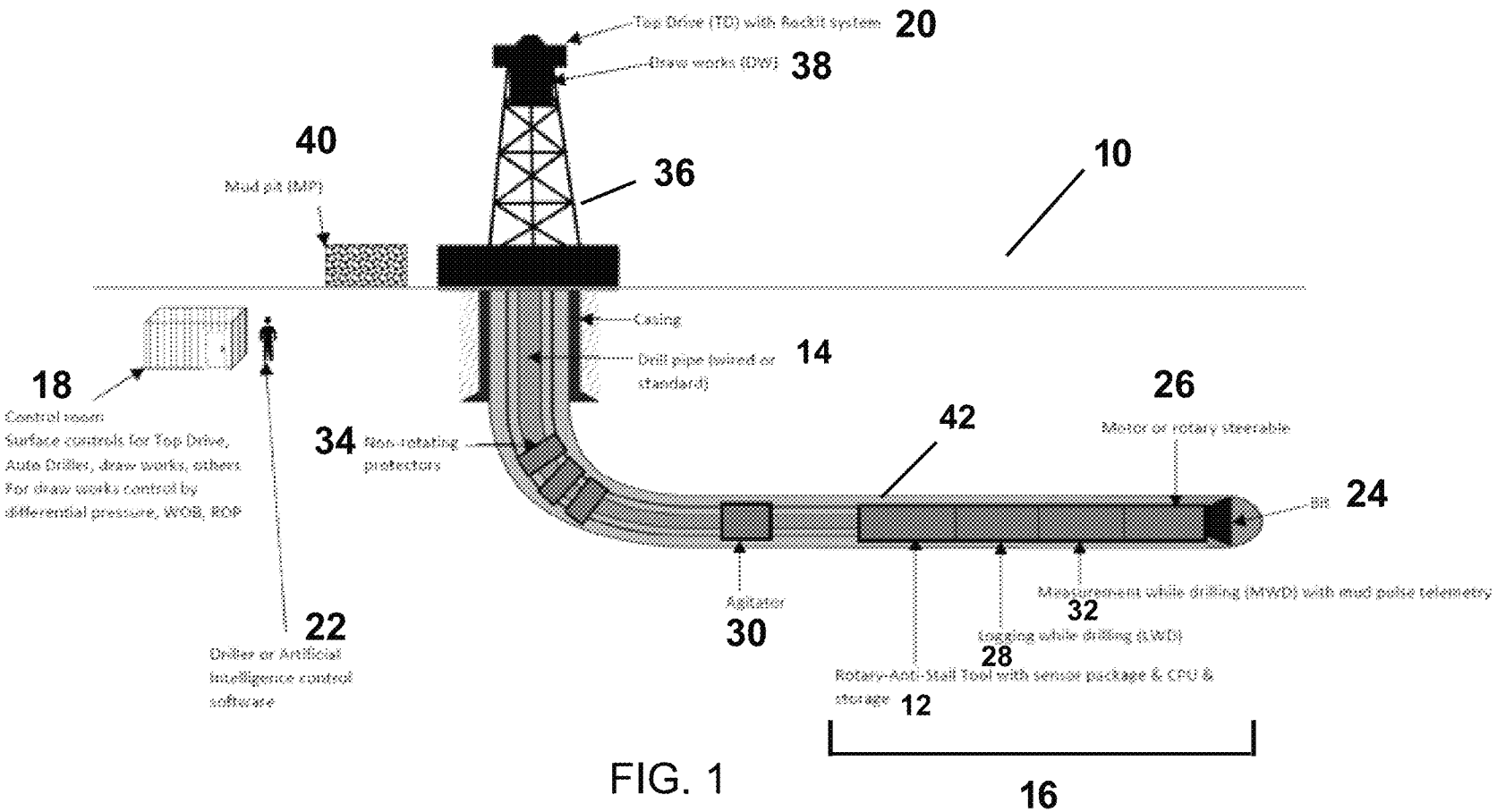
FIG. 1 is a system schematic of an active torque downhole and surface drilling control system.

The present invention is a method and downhole active torque control system including an Anti-Stall Tool or Anti-Stall Device (collectively referred to herein as an "ASD") with active torque communication to surface equipment. As shown in FIG. 1, the downhole active torque control system 10 includes an ASD 12 that measures torque, vibration measurement, ROP, or other downhole performance parameters and includes firmware-software for evaluation of torque drilling criteria including functional drilling, dysfunctional stick slip, whirl and chaotic whirl or other downhole parameters and criteria. The system includes drill pipe 14, including any tools in the BHA 16. The system further includes rig surface sensing equipment 18 having controls and AutoDriller, a top drive 20, and operators or AI software 22. Optionally equipment 18 can include a surface display that presents information (torque) measurements (and other parameters) and provides recommendations to the driller operator or the AutoDriller and automated equipment to make appropriate drilling adjustments (changes in WOB or other parameter).

The drill string may consist of a drill bit 24, positive displacement mud motor 26, downhole-to-surface communication system 28, drill pipe 14, drill collars, agitators 30, MWD (Measurement-While-Drilling) 32, non-rotating drill pipe protectors 34, and downhole sensors.

The downhole active torque control system 10 can be used in conjunction with any existing downhole-to-surface communication system including mud pulse telemetry, wired pipe, electromagnetic communication, or monitoring of downhole differential pressure. These existing downhole-to-surface communication systems are available commercially from multiple vendors and suppliers.

FIG. 1 further illustrates a drilling rig 36 with the top drive 20, draw works 38, mud pumps 40, control software for surface equipment including "rocking" software, downhole-to surface communication system, drill pipe 14, ASD 12 with torque control algorithms, drill bit 24 and may include downhole tools such as agitators 30 and non-rotating drill pipe protectors 34, and vibration absorption devices.

In this system 10, the ASD includes several sensors as disclosed in U.S. Pat. No. 8,833,487, the contents of which are incorporated herein by reference, that measures torque on bit, 3-axis vibration, lateral bending, WOB, RPM (rev/min), position and/or ROP, and time. In addition, the ASD can include multiple strain gage sensors and gyro, this combination of sensors will be used for determining whirl discussed in more detail herein on torque control criteria. Other sensors may include change in RPM (differential RPM, flowrates, and tool face). Optionally, the ASD may be equipped with sensors that measures/locates the amount of movement of the tool known as stroke, and thereby determines when the tool must be "reset" to allow its continued function.

Figure 2:
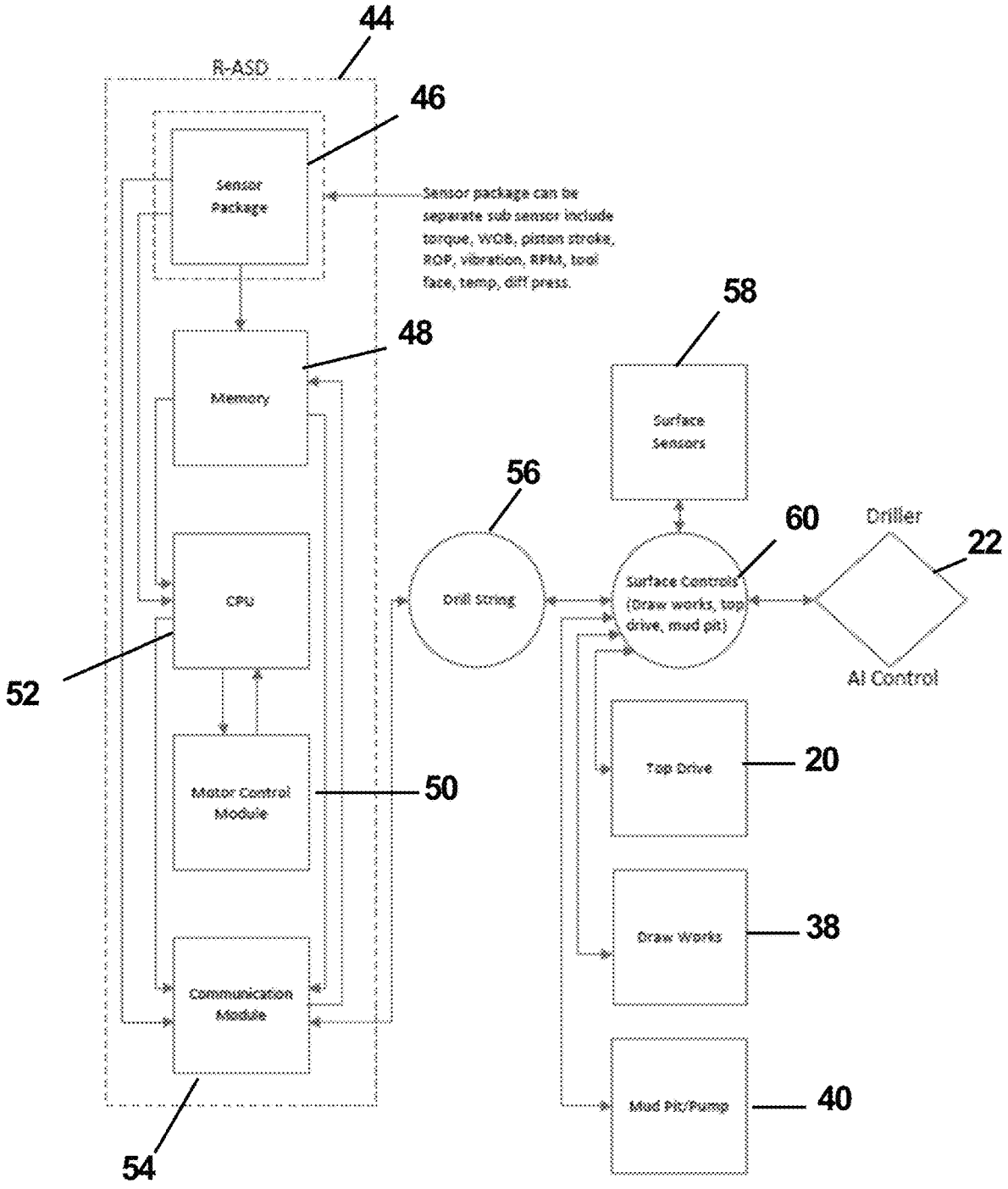
FIG. 2 is a flow chart of the control system of FIG. 1.

In the system 10, the ASD contains a hydro-mechanical section 42 and an electronics section 44. The hydromechanical components of the ASD are the same as discussed in U.S. Pat. No. 8,833,487. An electronics section block diagram is shown in FIG. 2. The electronics section 44 consists of several modules. In one embodiment the electronics consists of a sensor package 46, an electronic memory 48, a motor control module 50, and a CPU 52.

Within the electronics module, there is communication between the major subsections. For example, the CPU is in communication to the motor control module, memory, sensor package, and algorithm calculations module.

The essential significant difference of this invention over prior art is that the downhole actions to control WOB and ROP are taken by the ASD virtually immediately upon encounter of the event as dictated by torque control algorithms, and subsequently surface equipment is informed of the actions via torque changes that are measured at the surface. Algorithms located in a surface computer can interpret surface torque changes as changes in downhole torque. Using rig surface data for torque, a surface data can be displayed on screens and recommendations presented to the Driller to increase or decrease WOB as needed by downhole changes. Similarly, the recommendations based on interpretation of surface torque can be used as input to AutoDriller to control and optimize the drilling process. The net effect is more efficient drilling and greater ROP.

Effectively the ASD creates a downhole closed loop control system that modifies the WOB when the drill bit encounters drilling problems such as stick slip, whirl, chaos drilling or excessive vibration. In essence the ASD provides near real time responses and informs surface equipment to make gross adjustments, if necessary.

As shown in FIG. 2, within the ASD 12 are the sensor package 46 that may include a torque sensor, a differential pressure sensor, 1, 2 or 3 axis vibration sensors, or sensors for WOB, Revolution per Minute (gyro), flowrate, temperature, orientation (tool face) time, internal piston position, and strain gages that measure bending moment; the memory 48 with storage capacity to monitor all sensors at least on 1-10 second intervals for downhole duration of 1-10 days and when alerted to gather data at 0.005 second intervals; the CPU 52 with firmware and software to process data and using algorithm(s) evaluate sensor response and apply criteria to command and control the electronically operated motors and provide commands and receive information to the communications module 54 capable of operating at 100-350 degrees F.; the motor control module 50 that receives commands from the CPU and then commands and controls the electric motors that operate the valves within the ASD and action by the ASD to increase/decrease/hold WOB thereby affecting downhole torque and via the drill string 56 changing observed torque levels at surface, which is observed by surface sensors 58, recorded, and acted upon by surface controls 60, personnel 22 and equipment.

The surface equipment and controls consist of existing systems that typically include a derrick with the top drive 20, draw works 38, mud pumps 40, blow out preventer safety equipment, surface sensors 58, drill pipe 14, and the software equipment controls 18. This equipment can be provided in separate components or by integrated suppliers and may include vendors such as Halliburton, Schlumberger, Nabors, Patterson, Varco, Baker-GE, and many others.

Method of Operation Active Downhole and Surface Drilling Control

The method of the active downhole and surface drilling control system is the following for rotary drilling (non-sliding) operations.

The ASD measures downhole drilling parameters then sends commands for the tool to move, forward, backward, or no movement of its piston resulting in increasing, decreasing, or not changing the WOB. The change in WOB at the drill bit results in change in torque at the drill bit, the change in torque affects the drill string torque measured at the surface providing information about downhole drilling actions near the drill bit.

Step 1: The sensor package in the ASD detects the change in torque (increasing) via a torsional transducer, pressure sensors, accelerometers, or other sensor.

Step 2: The measurement data is processed by the ASD for comparison to programmed algorithms. Different control algorithms include torsional stick slip index, whirl Index, time-averaging of torque or other. These are discussed in more detail herein.

Step 3: The ASD moves (extend/retract/no change) per applicable algorithm.

Step 4: The change in WOB results in change in torque at the bit and at the surface. The information of torque change may result in actions by the driller or a programmed response of the AutoDriller.

Step 5: Sensors within the ASD are updated as a result of the action as per step 1.

For example, the drilling torque is averaging 5000 ft-lbs. and operates continuously between 5500-4500 ft lbs. The surface equipment receives information that the ASD has retracted via drill string torque. In nearly real time, the ASD reduces the drilling torque. The driller (or AutoDriller software) decides on any changes in WOB. If for example the ASD sends the information that it has retracted two times within a 2-minute interval, the driller at the surface realizes that average WOB at the drill bit is too high. The surface operator or programmed equipment would then know it must reduce the WOB (hook load) preventing excessive drilling vibration, improving drilling efficiency, and assisting reducing the probability of motor stalls. In addition, the reduction of WOB would allow the ASD to reposition itself and continue its rapid adjustment to downhole changes.

Another example is when the ASD repeatedly attempts to increase drilling WOB and torque. This would indicate whirling at the drill bit. The repeated actions by the ASD and its communication via torque changes to the surface sensors would alert the driller/automatic drilling software the need to increase the surface WOB. This action would increase average drilling efficiency and assist in preventing damage to the drill bit because of whirling action.

In addition, changes in downhole torque can be conveyed to surface from the ASD. For example, when the downhole motors wear, the overall average toque produced at a pressure tends to reduce. As this happens, the surface display reflects the reduction in average torque thereby providing the driller an indication that motor replacement may be necessary.

Figure 3:
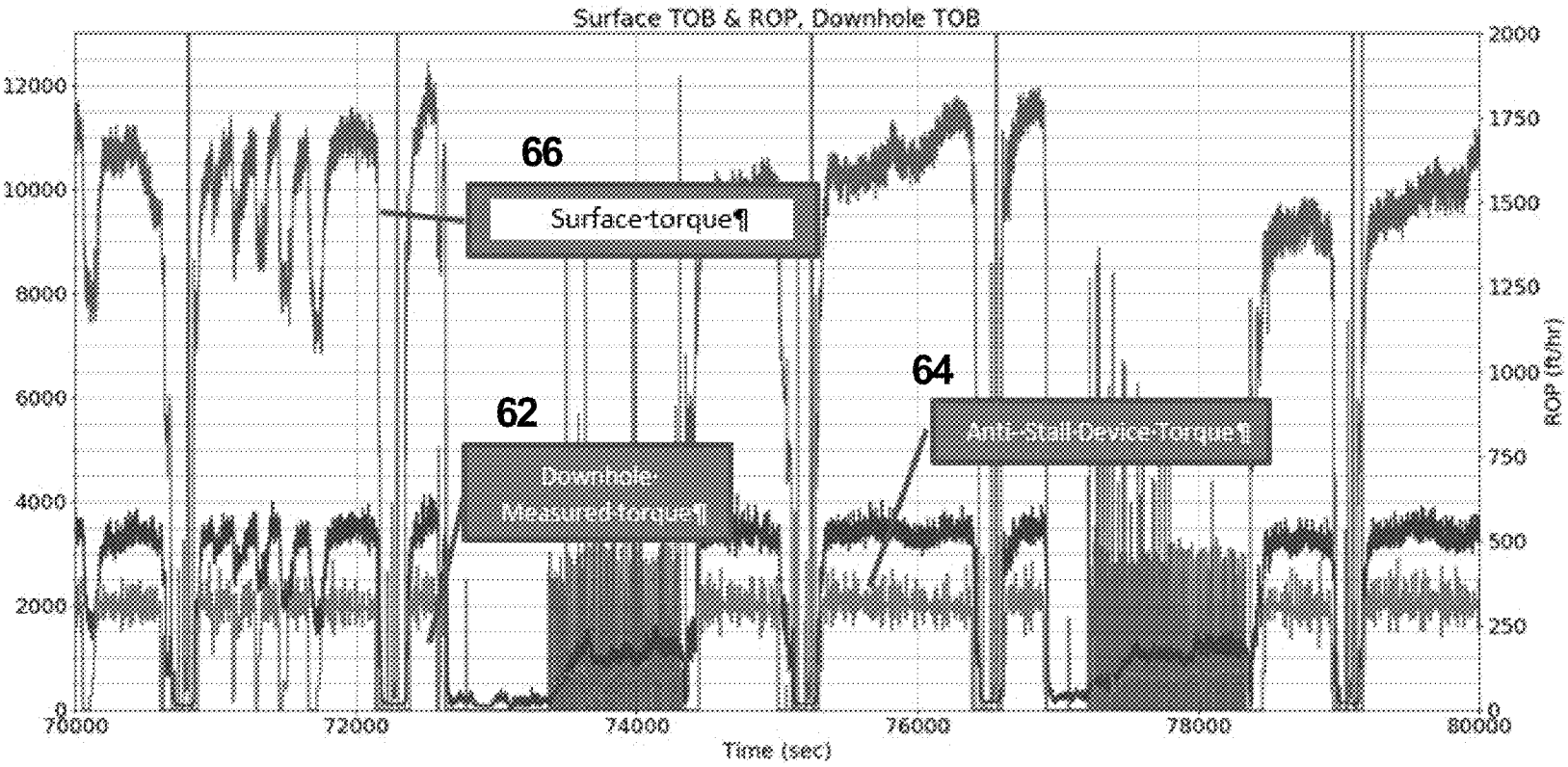
FIG. 3 is a graph comparing downhole instrument measured torque, Anti-Stall Device-measured torque, and surface-measured torque.

FIG. 3 shows an example of torque data as measured by a downhole sensor package 62, an ASD torque sensor 64, and surface torque measurements 66. As expected, the magnitude of the torque, resulting from WOB changes from the ASD, decreases along the length of the string and therefore a minimum at surface. After adjustment for time delay of approximately 1 second from the BHA to the surface, it is seen that a direct correlation exists, hence, direct communication from the bottom of the hole to the surface in about 1 second which is much faster than mud pulse telemetry. With this downhole torque information, the ASD can direct the actions to the driller or AutoDriller draw works for commands to increase or decrease drill string weight.

Applications of Torque Communication in Drilling

The ability of rapid communication from the drill bit to the surface instrumentation has many applications for drilling optimization. Described is a method for drilling vertical and horizontal wells with the ASD using torque to communicate to surface equipment and to the driller. The method describes the response by the ASD and the torque communication to surface for various drilling situations. The actions by the ASD and the torque communication are controlled by software/firmware programs within the ASD. The ASD is designed to respond to any order of drilling situations, hence no order of events is necessary.

To illustrate a typical drilling scenario could be applicable to drilling the vertical build section, or horizontal sections. The ASD diagnosis various drilling scenarios and responds by changing the WOB and hence torque that is observed at the surface by instrumentation and drilling personnel. With the torque information, the driller or the AutoDriller can make appropriate "gross" adjustments via the surface equipment while the ASD continues to diagnosis and respond in real time to the drilling conditions.

Using programmed logic, the ASD method responds to 1) avoid/control stick slip when rotating; 2) avoid/control stick slip when sliding; 3) avoid/control whirl when rotating; 4) avoid/control stick slip when sliding; 5) test for optimum WOB (and ROP); 6) maintain drilling optimization; 7) drill pipe make up operation; 8) optimize rotating to sliding operations; 9) optimize sliding to rotating; 10) reset ASD stroke to allow continuous operation; and 11) assist in control of tool face orientation for sliding. It is clear that other drilling scenarios are possible that the ASD can control.

Method for Identifying and Controlling Downhole Stick-Slip

As per Step 2 defined above in comparing current drilling data to criteria that identify drilling conditions, the ASD utilize algorithms to determine and respond to both normal drilling function and dysfunction. Common dysfunctions are stick-slip (torsional vibration), whirl (lateral vibration), chaotic whirl (torsional and lateral vibration), and bit bounce (axial vibration). Hence, it is necessary to use a metric to determine when dysfunction occurs.

After thorough examination of downhole torque data measure by the ASD and compared to surface RPM data, a torque-based stick slip index was proven accurately predictive in 161 downhole events in one well.

$$\text{TSSI}=\text{Torque Stick-Slip Index}=\text{Torque}_{max}-\text{Torque}_{min}/\text{Torque}_{ave}.$$

$$\text{TSSI}>0.2 \text{ Stick Slip is occurring}$$

For the TSSI, the average torque is measured over a recent drilling period (1-10 seconds, but typically 5 seconds). For the TSSI, when equation 2 is greater than 0.2, stick slip is occurring. If the TSSI has a positive number, the torque level is increasing; if negative, then the torque is decreasing. The TSSI has accurately measured stick slip in 161 events in one well.

A significant feature of the TSSI is its ability to "float" with drilling conditions. Unlike controlling torque via preset maximum torque levels for a stick-slip event, the TSSI effectively "floats" to the most recent (1-10 second) drilling conditions. Therefore, if a formation is more-or-less drillable, the ASD adjusts to the conditions by avoiding fixed conditions and allowing improved drilling rates.

The use of the TSSI is to direct the ASD to reduce WOB rapidly. For example, when drilling ahead the drill bit sticks into the formation, the ASD measures the torque, evaluates the condition via TSSI, and reduces WOB that reduces torque-on-bit that via changes in the drill string torque measured at the surface. TSSI is applicable to any drilling situation including rotating drilling, slide drilling, transition from Rotating to Slide drilling, transition from Slide Drilling to rotating drilling.

Method for Drilling Optimization Using Torque Stick Slip Index Algorithm in ASD

A primary objective to increasing drilling efficiency is to drill with the highest ROP without inducing stick slip. In this method, the ASD is programmed to periodically (typically every 5-10 minutes) to increase the WOB and evaluate the TSSI. The amount of increase can be programmed into ASD, but typically is 5-10% increase. If at the greater WOB the TSSI is not exceeded, the ASD is commanded to continue with this WOB. If the TSSI is exceeded, the ASD is commanded to quickly (within 2-5 seconds) to reduce the WOB to the previous condition. This process is repeated during the drilling to continually strive to increase ROP.

Method for Identifying and Controlling Downhole Drill Whirl

Another drilling dysfunction while drilling is whirl that should be accurately identified, thereby allowing the ASD to adjust (increase) WOB and maximize ROP. A whirl index must evaluate the magnitude of the dysfunction and determine the significance to thereby allow the ASD to respond (typically increase WOB).

After examination of available data of a vertical rotating shaft known to have either positive whirl (clockwise) or negative whirl (counterclockwise), a Whirl Index based on data near the drill bit has proven to accurately predict this drilling dysfunction.

$$\text{WI}=\text{Whirl Index}=\text{Bending Moment}_{max}-\text{Bending Moment}_{min}/\text{Bending Moment}_{ave}$$

$$\text{WI}>1.0 \text{ Whirl is occurring.}$$

Whirl is occurring when WI is greater than 1.0. The average bending moment is determined over a specified period (typically 1-2 seconds, but up to 10 seconds) in the ASD near the bit. The maximum and minimum bending moment occurs during the specified time interval. The maximum, minimum and average bending moment are determined by processing of signals from two strain gages attached 90 degrees apart on the rotating shaft over a specified time interval. The time interval for the data evaluation of whirl can be 0.004-0.05 seconds. The data sampling rate can be typically 1 data point per 0.0025 seconds to allow determination of changes in lateral bending moment of 200 Hz. The data samples can be taken, evaluated, and discarded or stored followed by obtaining another data set.

The method utilizes two strain gages attached to the shaft parallel to the axial direction at exactly 90 degrees apart and thus in two orthogonal planes. Bending strain is related to bending moment via the known elastic modulus (E) and the moment of inertia (I).

The use of the WI is to direct the ASD to increase WOB rapidly. For example, when drilling ahead, the ASD measures the bending moments as described above, evaluates the condition via WI, and increases WOB that increases torque-on-bit that via changes in the drill string torque measured at the surface. WI is applicable to any drilling situation including rotating drilling, slide drilling, transition from rotating to slide drilling, and transition from slide drilling to rotating drilling.

Method of Downhole Chaotic Whirl Identification and Control

Another downhole drilling dysfunction is chaotic whirl, which is a combination of stick-slip and whirl occurring simultaneously. The amount of stick-slip or whirl can vary from virtually all stick slip and very little whirl to nearly all whirl and very little stick slip.

This method uses both the stick slip index and the whirl index to control the drilling dysfunction. In this method, both downhole torque and the bending moments sensors are operating. The steps of the method area 1) both the TSSI and the WI criteria are exceeded, 2) the ASD reduces WOB, and the TSSI and WI are re-evaluated, 3) if the drilling dysfunction is stopped and the TSSI is below the criterion, the ASD will hold the reduced WOB, 4) if the TSSI is unchanged and the WI is the same or higher, the ASD increases WOB, 5) the WI is re-evaluated, 6) if the WI is reduced below the criterion, the ASD is commanded to hold the increased WOB, 7) if neither TSSI or WI is changed by the actions, the ASD is commanded to return to its original WOB. If step 7 has occurred, the reason is that the chaotic whirl is probably not located between the ASD and the drill bit. This method is applicable to any drilling situation including rotating drilling, slide drilling, transition from rotating to slide drilling, and transition from slide drilling to rotating drilling.

Method of Slide Drilling Controlling Tool Face by Controlling Torque

A problematic situation is the transition from rotating to slide drilling. The objective of this event is to redirect the drilling in a specific direction, which is controlled by the tool face orientation that is conveyed by the MWD to the surface. It is essential during this process that the orientation remain as constant as possible, thereby preventing additional drilling course directional changes. This method defines how the ASD retains nearly constant torque during the starting and drilling of the sliding section of the well.

For obtaining constant tool face during sliding, the ASD can have an additional gyro. When the slide begins, the gyro position is recorded in the ASD. The steps for controlling the tool face with the ASD are the following: 1) constantly measuring torque and bending moment and thereby determining TSSI, WI, and the gyro last position before the slide starts; 2) the ASD is programmed to maintain the gyro's orientation by changes in WOB producing a constant torque during the slide. Optionally, during the slide, step 3) the ASD has constant rate of increase of torque from the beginning of the slide to a maximum torque as defined from step 2. Constant torque on the drill bit results in nearly constant tool face, and thereby reduces the need for additional corrections. This is a major improvement to drilling efficiency.

Figure 4:
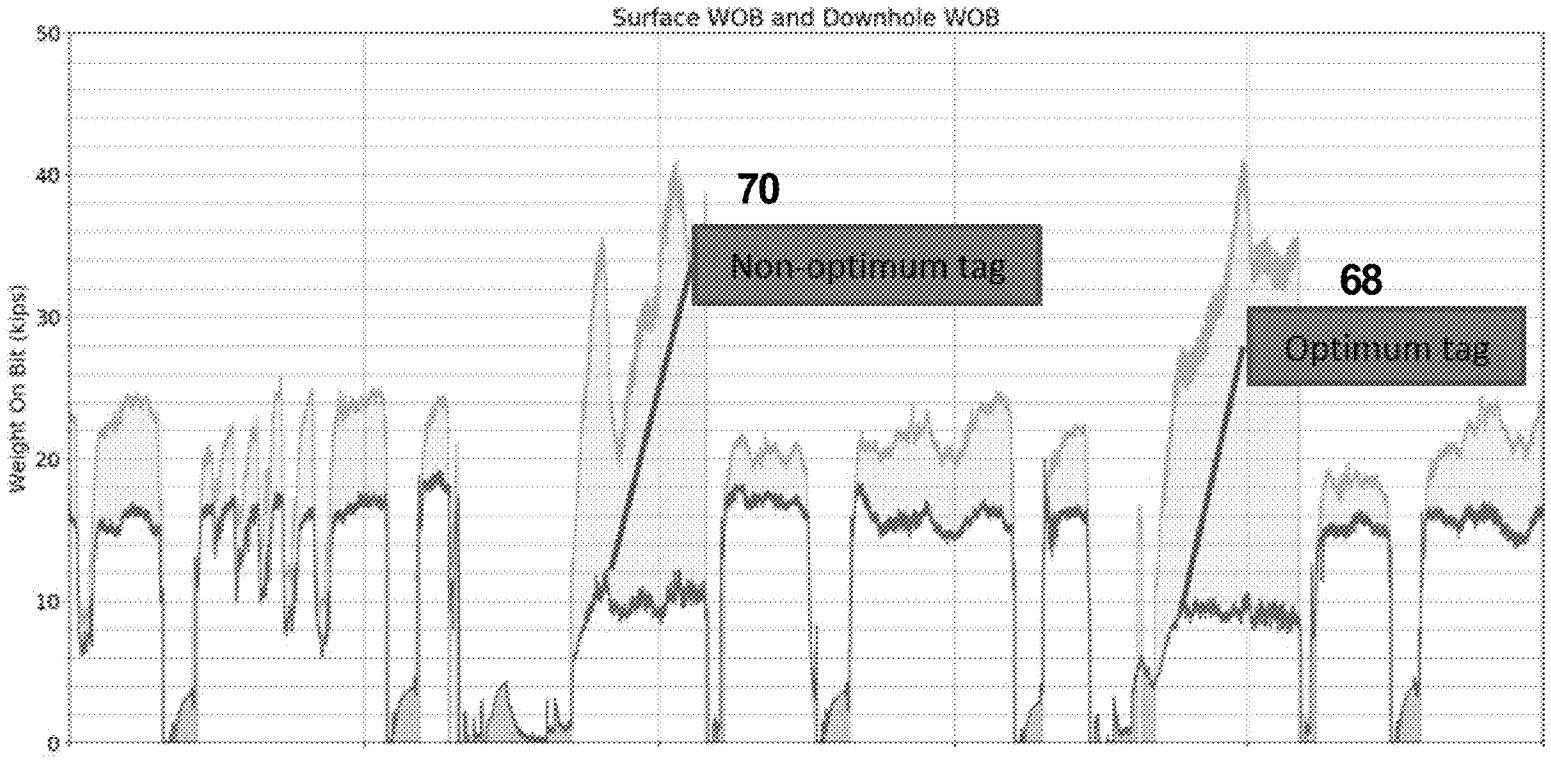
FIG. 4 is a graph illustrating weight on bit during an optimum touching bottom versus a non-optimum actual touching bottom.

An example of an "optimum" tag 68 (touching bottom) versus a non-optimum "actual" tag 70 is illustrated in FIG. 4 where a downhole WOB spike with the non-optimum tag can be seen.

Method of Aggregate Vibration Identification and Control

Drilling dysfunction can be the result of drill string axial vibration (bit-bounce), lateral vibration (whirl) or torsional (stick slip). The result of excessive vibration can be any and all these vibrations occurring individually or simultaneously. Reduction of vibration results in faster ROP, fewer trips to the surface, and less damage to downhole equipment.

An alternative method of controlling drilling dysfunction is by evaluating overall vibration levels using a vibration index (VI). This method uses accelerations measured by 3-axis accelerometers, which are typically oriented with an x, y, z coordinate system with z-axis along the axis of the drill string, x-axis in radial direction, and y-axis in the tangential direction. Frequently, accelerations are expressed in (g) as units of earth's gravitation force (32.2 ft/sec$^2$).

Where the following have definitions:

$g_{xmax}$=absolute value of maximum acceleration in x-axis over specific time (1-2 seconds)

$g_{ymax}$=absolute value of maximum acceleration in Y direction over a period $g_{zmax}$=absolute value of maximum acceleration in Z direction over a period $g_{rms}=(g^2_{xmax}+g^2_{ymax}+g^2_{zmax})^{1/2}$ The criteria for application of vibration to direct the ASD to reduce or change WOB are the following:

$g_{xmax}$=>15 gs $g_{rms}$=>15 gs

The method is that the ASD will 1) measure and record the absolute maximum accelerations in all three axes over a specified time (1-5 seconds) at/near the bit, then 2) evaluate if $g_{xmax}$ or $g_{rms}$ exceeds the limit, and if so the ASD reduces WOB, and 3) repeat steps 1 and 2.

Finally, the $g_{xmax}$ and $g_{rms}$ criteria levels can be adjusted for various formations and the BHA. For example, a $g_{rms}$ of 15 gs is not a significant problem when drilling in Bakken shale were hard stringers are only intermittently encountered. However, when drilling in some Permian basin formations were some formations can be consistently hard, a constant $g_{rms}$ of 15 gs would result in an excessive number of MWD failures. Hence the g levels are empirically developed for each formation and typically range from 10-25 gs. The ASD has adjustable set points for the $g_{rms}$ or $g_{xmax}$ to address variations of drilling formation.

Method to Reposition ASD

The ASD has a limited stroke (typically 10 inches) to adjust the drilling WOB. After several adjustments (increasing/decreasing WOB) the ASD may have insufficient length to respond to the required actions.

In this method, the ASD is programmed to move to reposition the piston to allow movement sufficient to continue operation. This is accomplished by 1) detecting tool face at the beginning of the slide, 2) slowly advancing the position of the piston in the ASD which will result in an increase in the WOB and torque-on-bit (TOB), 3) the increase TOB is detected at the surface by the surface sensors and the driller, and 4) the driller will decrease the WOB, thereby allowing the ASD to extend to re-set itself.

Method of Communicate Changes in Downhole Conditions via ASD and Drill String Torque A method to communicate downhole conditions to the surface via ASD changes in WOB and resulting drill string torque changes can be generalized to communicate to the surface for many downhole conditions. In the current embodiments described, changes in downhole torque or vibration are communicated to the surface via drilling string torque.

Any downhole measurement, including but not limited to ROP, differential pressure, tool face orientation, RPM, 3-axis position, sudden well gas incursion, presence of H2S, formation lithography, as well as others, can be measured downhole and the ASD can be programmed for specific movements that can be communicated to surface quickly to provide information to the surface.

In this method, after an appropriate sensor detects the change, the ASD responds with a program response of changing WOB, that is reflected and identified as change of torque at the surface. Based on current communications speed of approximately 1-2 bits/second, a language protocol is created to provide communication to the surface for the chosen downhole parameter.

The over-reaching benefit of the methods described are to drill faster and more efficiently. The cost of drilling wells is directly related to the drilling time, faster drilling reduces cost. The methods described have resulted in reduction of rotary drilling times of 10-30% for some well sections. This time savings directly reduces cost for drilling a well proportionately.

Faster drilling is achieved through several means. The occurrence of stick-slip, whirl, and chaotic whirl during drilling produces vibrational energy that is not delivered for the removal of rock; hence, control and elimination of stick-slip, whirl, and chaotic whirl result in faster drilling. In addition, stick-slip, whirl, and chaotic whirl damage drilling string components frequently resulting in downhole equipment failures and trips to surface to replace failed equipment, and all associated costs.

A benefit of a "torque-based" communication system using the drill string and an ASD is that it provides nearly real-time communication of downhole changes in torque and required adjustments and allows for preventive actions. The communication is much faster (10-25 times) greater that mud pulse telemetry from MWD. For example, when drilling ahead into a "sticky formation" (i.e., a soft formation that allows greater cutter penetration at a WOB), the downhole motor can stall and potentially fail (requiring a trip). With the ASD and communication to the surface via drill string torque, the ASD will immediately reduce WOB preventing the stall and the driller at the surface seeing the rapid change and magnitude of drill string torque would know that a "sticky" formation is encountered and reducing WOB is required.

Another significant benefit of the methods described is facilitating slide drilling. When drilling horizontal wells with bent motors, frequent course corrections are required. The process of stopping rotary drilling, setting up for the direction correction for the slide, starting the slide, and controlling the slide consumes about half of the drilling time of drilling the horizontal section of a well. With the method described, slide drilling times can be reduced by up 10-30%.

Although the present invention has been described herein with respect to a downhole active torque control system and methods, it is to be understood that the invention is not to be so limited since changes and modifications can be made therein which are intended to be within the scope of the invention as hereinafter claimed.

What is claimed is:

1. A method of adjusting near-bit weight on a drill bit in a drill string having a bottom hole assembly located at an end of a drill pipe, an anti-stall device near the bottom hole assembly, surface sensing and control equipment and a downhole-to-surface communication system, the anti-stall device having means for measuring downhole performance criteria and means for evaluation of the measured downhole performance criteria, comprising the steps of:

measuring at least one downhole performance criteria by the anti-stall device;

evaluating the measured downhole performance criteria in substantially real time by the anti-stall device;

adjusting weight on the drill bit by the anti-stall device based on the evaluation by the anti-stall device; and communicating the adjustment to weight on the drill bit to the surface sensing and control equipment by the downhole-to-surface communication system, wherein the downhole performance criteria measure is torque and the step of evaluating the measured downhole performance criteria includes applying a torque stick-slip index algorithm of $\text{Torque}_{max}-\text{Torque}_{min}/\text{Torque}_{ave}$, and wherein a result greater than 0.2 of the stick slip index algorithm results in a determination of a stick slip condition and a reduction of weight on drill bit by the anti-stall device.

2. The method of claim 1 further comprising the steps of:

measuring drilling performance criteria at a surface of the drill string based on the communicated adjustment to weight on the drill bit; and adjusting drilling operations from the surface of the drill string based on the measured drilling performance criteria at the surface.

3. The method of claim 1 wherein the downhole performance criteria measured and evaluated by the anti-stall device further includes at least one of vibration, rate of penetration, bending moment, weight on drill bit, revolutions per minute, time, whirl or tool face location.

4. The method of claim 1 wherein the step of measuring downhole performance criteria includes drill string torque changes and the downhole-to-surface communication system further communicates the drill string torque changes.

5. The method of claim 1 further comprising the steps of:

determining if the anti-stall device is incapable of additional movement to retract;

commanding the anti-stall device to slowly automatically advance;

measuring at a surface of the drill string increase in drill string torque by the surface sensing and control equipment;

reducing weight on the drill bit from the surface; and re-extending and repositioning the anti-stall device.

6. A method of adjusting near-bit weight on a drill bit in a drill string having a bottom hole assembly located at an end of a drill pipe, an anti-stall device near the bottom hole assembly, surface sensing and control equipment and a downhole-to-surface communication system, the anti-stall device having means for measuring downhole performance criteria and means for evaluation of the measured downhole performance criteria, comprising the steps of:

measuring at least one downhole performance criteria by the anti-stall device;

evaluating the measured downhole performance criteria in substantially real time by the anti-stall device;

adjusting weight on the drill bit by the anti-stall device based on the evaluation by the anti-stall device; and communicating the adjustment to weight on the drill bit to the surface sensing and control equipment by the downhole-to-surface communication system, wherein the downhole performance criteria measure is bending moment and the step of evaluating the measured downhole performance criteria includes applying a whirl index algorithm of $\text{Bending Moment}_{max}-\text{Bending Moment}_{min}/\text{Bending Moment}_{ave}$, wherein a result equal to or greater than 1.0 of the whirl index algorithm results in a determination of whirl and an increase of weight on drill bit adjustment by the anti-stall device.

7. A method of adjusting near-bit weight on a drill bit in a drill string having a bottom hole assembly located at an end of a drill pipe, an anti-stall device near the bottom hole assembly, surface sensing and control equipment and a downhole-to-surface communication system, the anti-stall device having means for measuring downhole performance criteria and means for evaluation of the measured downhole performance criteria, comprising the steps of:

measuring at least one downhole performance criteria by the anti-stall device;

evaluating the measured downhole performance criteria in substantially real time by the anti-stall device;

adjusting weight on the drill bit by the anti-stall device based on the evaluation by the anti-stall device; and communicating the adjustment to weight on the drill bit to the surface sensing and control equipment by the downhole-to-surface communication system, wherein the step of evaluating the measured downhole performance criteria includes applying a stick-slip index algorithm and a whirl index algorithm and a tool face position at a beginning of a slide drilling operation.

8. The method of claim 7 wherein the step of adjusting weight on the drill bit by the anti-stall device is to maintain constant torque thereby maintaining control of an orientation of the drill bit during the slide drilling operation.

9. A method of adjusting near-bit weight on a drill bit in a drill string having a bottom hole assembly located at an end of a drill pipe, an anti-stall device near the bottom hole assembly, surface sensing and control equipment and a downhole-to-surface communication system, the anti-stall device having means for measuring downhole performance criteria and means for evaluation of the measured downhole performance criteria, comprising the steps of:

measuring at least one downhole performance criteria by the anti-stall device;

evaluating the measured downhole performance criteria in substantially real time by the anti-stall device;

adjusting weight on the drill bit by the anti-stall device based on the evaluation by the anti-stall device; and communicating the adjustment to weight on the drill bit to the surface sensing and control equipment by the downhole-to-surface communication system, wherein the step of evaluating the measured downhole drilling performance criteria includes applying a downhole drilling vibration index algorithm of $g_{xmax}$=>15 gs and $g_{rms}$=>15 gs, wherein conditions within the downhole drilling vibration index algorithm result in a reduction of weight on the drill bit until downhole drilling vibrations are controlled.

10. A drilling system for adjusting weight on a drill bit comprising:

a drill pipe;

a drill bit positioned at a downhole end of the drill pipe;

an anti-stall device within the drill pipe near the drill bit, the anti-stall device having means for measuring downhole drilling performance criteria and means for evaluating the measured downhole drilling performance criteria in substantially real time, the anti-stall device adjusting weight on the drill bit based upon the evaluated downhole drilling performance criteria;

surface sensing and control equipment at a surface of the drilling system; and a downhole-to-surface communication system for communication of the adjustment to the weight on drill bit by the anti-stall device to the surface sensing and control equipment wherein the means to measure downhole drilling performance criteria includes sensors to sense change in differential revolutions per minute, flowrates and tool face.

11. The system of claim 10 wherein the surface sensing and control equipment includes Autodriller with control software, a top drive and mud pumps having control software.

12. The system of claim 10 wherein the downhole-to-surface communication system is one of mud pulse telemetry, wired pipe, electromagnetic communication or monitoring of downhole differential pressure.

13. The system of claim 10 wherein the means to measure downhole drilling performance criteria further includes sensors that measure at least one of torque on bit, 3-axis vibration, lateral bending, weight on bit, position or rate of penetration, and time.

14. The system of claim 10 wherein the means to measure downhole drilling performance criteria further includes sensors to measure or locate the amount of movement of the tool and the ant-stall device adjusts weight on the drill bit to maintain constant torque to control orientation of the tool face.

15. The system of claim 10 wherein the means for evaluating the measured downhole drilling performance criteria further includes at least one of a stick-slip index algorithm, a whirl index algorithm and a downhole drilling vibration index algorithm.

* * * * *